United States Patent [19]

Bose

[11] 4,146,242

[45] Mar. 27, 1979

[54] SAFEGUARDING DEVICE FOR SKIS AND SKI POLES

[76] Inventor: Herbert Böse, Am Dachsbau 9, 6231 Neuenhain, Fed. Rep. of Germany

[21] Appl. No.: 750,203

[22] Filed: May 10, 1977

[30] Foreign Application Priority Data

Oct. 8, 1976 [DE] Fed. Rep. of Germany ..... 2645488

[51] Int. Cl.[2] ..... A63C 11/02

[52] U.S. Cl. ..... 280/11.37 A; 24/73 SG; 24/81 SK; 70/58

[58] Field of Search ..... 280/11.37 K, 11.37 A, 280/11.37 R, 11.37 C; 70/58, 59; 211/60 SK; 24/81 SK, 73 SG; 224/45 S, 5 Z

[56] References Cited

U.S. PATENT DOCUMENTS

| | | | |
|---|---|---|---|
| 3,486,672 | 12/1969 | Esopi | 24/81 SK |
| 3,838,585 | 10/1974 | Foote | 70/58 |
| 3,892,343 | 7/1975 | Warner | 280/11.37 K |
| 3,999,409 | 12/1976 | Bell | 70/58 |
| 4,057,983 | 11/1977 | Morgan | 70/58 X |

*Primary Examiner*—David M. Mitchell
*Assistant Examiner*—Milton L. Smith
*Attorney, Agent, or Firm*—Henry R. Lerner

[57] ABSTRACT

Safeguarding device for skis and ski poles, consisting of two oppositely arranged lockable clamp members which are connected by a cable. The lockable clamp members each have two substantially semicircular recesses to receive the two ski poles. The two clamp members are arranged for locking by a lock. The connecting cable is placed around the skis in the area of the binding and around a stationary support such as a fence, a railing, a ski rack or the like.

3 Claims, 5 Drawing Figures

SAFEGUARDING DEVICE FOR SKIS AND SKI POLES

BACKGROUND OF THE INVENTION

It happens again and again that skis and ski poles when deposited during periods of non-use in front of or in mountain huts, hotels, restaurants, on the top of cars or the like, are stolen or mixed up unintentionally. Although devices to prevent the theft of skis are known in the art these devices are generally not mobile but are fitted on the top of cars of arranged or so-called ski-parkometers. However, parkometers do not adequately secure the ski poles apart from the fact that they are installed only in very rare cases. The same applies to locking members fitted direct to the skis and to be connected by chains, and to bicycle locks which are used for this purpose occasionally to provide for a reasonable securement of the skis themselves.

SUMMARY OF THE INVENTION

Accordingly, it is a general object of the present invention to provide an improved safeguarding device for a pair of skis and the accompanying ski poles. It is another object of the present invention to remove the described disadvantages, i.e. to provide a safeguarding device for a pair of skis and the accompanying ski poles which secures both, the pair of skis and the poles by attaching them to a fence, a railing or a special ski rack, when available, or a car top-mounted ski support under consideration of the given different circumstances of railing, rack tubes, or the like.

Still another object of the present invention is to provide an improved safeguarding device the connecting cable of which is adjustable in length relative to two clamp members.

A further object of the present invention is to provide an improved safeguarding device the connecting cable of which is combined with a further cable for looping around a fence, a railing, a rack or the like.

The main object of problem is solved, according to the present invention, by two oppositely arranged lockable clamp members, each member having two recesses at the side facing the seating surface. The cross-sectional area of the recesses is about half the cross-sectional area of a ski pole, and the pole, and the two clamp members are connected by a flexible cable, which, with regard to its looping length is either connected with one end to one of the clamp members in an adjustable and detachable arrangement, or which, with the length appropriately adapted to the pair of skis, is associated with an endless flexible holding cable in such a way that the connecting cable is routed through two loops of the holding cable. The flexible connecting cable can be, for example, a steel rope or a light chain which may be provided with a plastic coating. The oppositely arranged lockable clamp members can preferably be locked by a built-in lock or by means of a pad-lock in which case the clamp members are provided with the necessary holes for inserting the pad-lock.

According to the present invention the connecting cable is looped around a suitable support such as a fence, a railing, a car top-mounted ski support or the like, and the pair of skis is placed between the binding elements before the two clamp members are closed around the ski poles and locked by the lock which is preferably of the built-in type. When the connecting cable is adjustable with regard to its looping length, the length is so adjusted in dependence of the circumference of the railing, rack tubing or the like that the assembled pair of skis is held tightly and cannot be removed from the safeguarding device. When the connecting cable only has a length sufficient for looping about the pair of skis and both ends are rigidly connected to the clamp members, the holding cable is looped about the pertinent and available tube or the like, and the connecting cable is pulled through the two loops formed by the holding cable.

The above brief description as well as further objects, features and advantages of the present invention will be more fully appreciated by reference to the following detailed description of the presently offered but nontheless illustrative embodiments in accordance with the present invention.

BRIEF DESCRIPTION OF THE DRAWING

In the various figures of the drawing, like reference characters designate like parts.

In the drawing.

DESCRIPTION OF THE PREFERRED EMBODIMENTS

Figure 1:
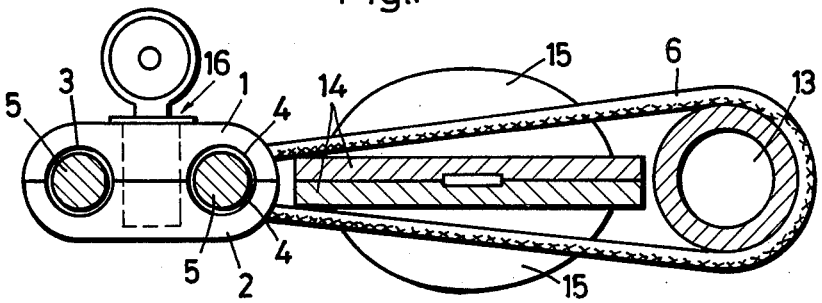
FIG. 1 is a plan view of the entire device with the pair of skis

According to FIG. 1 the two clamp members 1 and 2 which can be, for example, of plastics or metal are rigidly connected to each other only by connecting cable 6 so that it is readily possible to loop connecting cable 6 around a railing tube 13 and about the assembled pair of skis 14 between the ski binding elements 15. After placing ski poles 5 in recesses 3 and 4 clamp members 1 and 2 are locked by means of lock 16. In this version of the invention the looping length is about equal to the circumference of the pair of skis 14 and tube 13. The same applies to the version according to FIG. 2.

Figure 2:
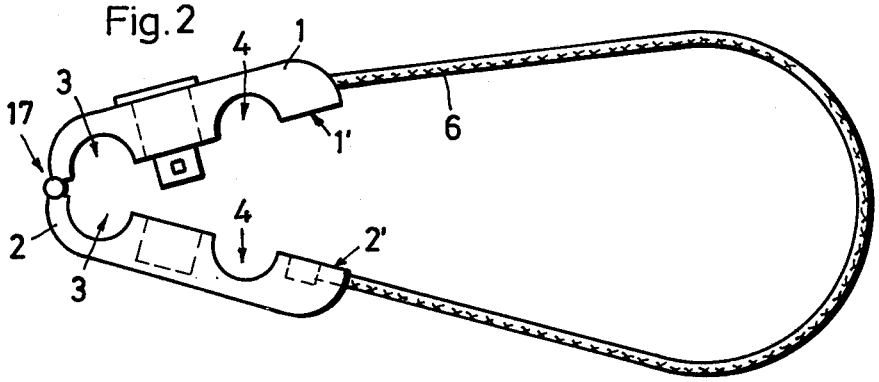
FIG. 2 is a plan view of a variation of the device.

According to FIG. 2 clamp members 1 and 2 may also be connected by a releasable hinged joint 19 in which case connecting cable 6 may be rigidly anchored with both ends to clamp members 1 and 2. When the hinged joint is not releasable one thickened end of connecting cable 6 is locked in recess 18 arranged in seating surace 2'. The other end of the connecting cable has locking elements 7 in a spaced apart arrangement each of which, depending on the length of the connecting cable required, is threaded through borehole 20 in clamp member 2 and held in position by recess 8 provided in clamp member 1 in a staggered position, when the two clamp members 1 and 2 are locked as described earlier.

Figure 4:
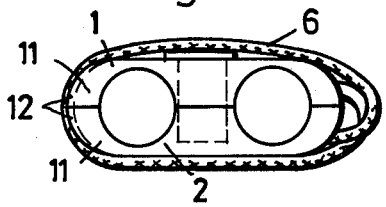
FIG. 4 is a plan view of the device according to FIG. 1 in collapsed condition.

For the convenient carrying of the device in the pocket the two clamp members 1 and 2 have, according to FIG. 4, grooves 12 at their ends 11 the depth and shape of which are adapted to the cross-section of connecting cable 6. After twisting connecting cable 6 by 180° at one end, as visible on the right in FIG. 4, the loop of connecting cable 6 can be stretched across clamp members 1 and 2 locked in notches 12.

Figure 5:
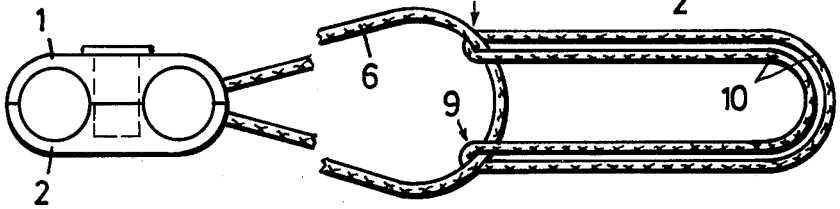
FIG. 5 is a plan view of a special variation of the device.

A particularly advantageous and preferred version of the invention is illustrated in FIG. 5 wherein connecting cable 6 can be adapted fairly accurately to the average circumference of the pair of skis 14 without having also to consider the diameter of a railing tube 13 or the like.

The specific feature is that connecting cable 6 is routed through loops 9 of an endless cable 10 which has previously been wrapped, more or less loosely, once or several times around railing tube 13 or the like.

Figure 3:
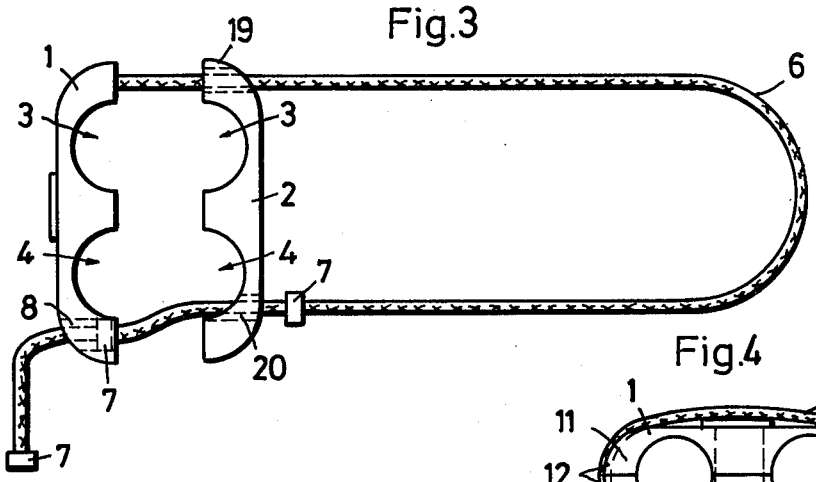
FIG. 3 is a plan view of a further variation of the device.

The adjustability of connecting cable 6 according to FIG. 3 can, of course, also be provided for the versions according to FIG. 1 and 2 when it is merely necessary that the free end of connecting cable 6, which is fitted with locking elements 7 and not required, is arranged to project from clamp members 1 and 2, and that the engaged locking element 7 is fixed after locking clamp members 1 and 2. By making minor modifications it is thus possible to readily transfer and apply the principles of the various versions to the other versions.

There has been disclosed theretofore the best embodiments of the invention presently contemplated. However, it is to be understood that various changes and modifications may be made thereto without departing from the spirit of the invention.

What is claimed is:

1. A safeguarding device for skis and ski poles, comprising two separable clamp members adapted to be locked together in confronting relation, the confronting surfaces of said clamp members being provided with juxtaposed pairs of side-by-side recesses having a cross section corresponding to half the cross section area of a ski pole, and a flexible cable having its opposite ends secured to said clamp members, saif flexible cable together with at least one of said clamp members defining a closed loop when said clamp members are in locked relation for retaining articles passed through said loop, said flexible cable having one end thereof secured to one end of one of said clamping members, being threaded through apertures at opposite ends of the other of said clamping members to form together with said other clamping member said closed loop, and having its opposite end secured to the other end of said one clamping member.

2. A device in accordance with claim 1, wherein the opposite end of the flexible cable is adjustably secured to said other end of said one clamping member.

3. A safeguarding device for skis and ski poles, comprising two separable clamp members adapted to be locked together in confronting relation, the confronting surfaces of said clamp members being provided with juxtaposed pairs of side-by-side recesses having a cross section corresponding to half the cross section area of a ski pole, a flexible cable having its opposite ends secured to said clamp members, said flexible cable together with at least one of said clamp members defining a closed loop when said clamp members are in locked relation for retaining articles passed through said loop, and an endless flexible cable adapted to be doubled up and wrapped around a support member to define loops at the free ends of said endless flexible cable through which loops said first mentioned flexible cable is threaded whereby to secure said safeguarding device to said support member.

* * * * *